US010370989B2

(12) United States Patent
Schlemmer et al.

(10) Patent No.: US 10,370,989 B2
(45) Date of Patent: Aug. 6, 2019

(54) GUIDE VANE SEGMENT WITH RADICAL SECURING ELEMENTS

(71) Applicant: MTU Aero Engines AG, Munich (DE)

(72) Inventors: Markus Schlemmer, Mainburg/Sandelzhausen (DE); Manfred Feldmann, Eichenau (DE); Rudolf Stanka, Rattenkirchen (DE); Oliver Thiele, Dachau (DE); Bernd Kislinger, Reisgang (DE); Manuel Hein, Karlsfeld (DE)

(73) Assignee: MTU Aero Engines AG, Munich (DE)

( * ) Notice: Subject to any disclaimer, the term of this patent is extended or adjusted under 35 U.S.C. 154(b) by 397 days.

(21) Appl. No.: 15/367,752

(22) Filed: Dec. 2, 2016

(65) Prior Publication Data

US 2017/0159466 A1 Jun. 8, 2017

(30) Foreign Application Priority Data

Dec. 4, 2015 (DE) ..... 10 2015 224 378

(51) Int. Cl.
*F01D 9/04* (2006.01)
*B24B 19/14* (2006.01)
*F01D 25/24* (2006.01)

(52) U.S. Cl.
CPC ..... *F01D 9/041* (2013.01); *B24B 19/14* (2013.01); *F01D 25/246* (2013.01); *F05D 2230/10* (2013.01)

(58) Field of Classification Search
CPC ... F01D 9/041; F01D 9/04; F01D 9/00; F01D 25/246; B24B 19/14
See application file for complete search history.

(56) References Cited

U.S. PATENT DOCUMENTS

2015/0044032 A1* 2/2015 Paradis ..... F01D 25/246 415/134
2015/0125289 A1 5/2015 Maltaverne et al.
2015/0226075 A1* 8/2015 Aoki ..... F01D 25/246 415/209.3
2016/0090840 A1* 3/2016 Watkin ..... F01D 9/042 415/209.3

FOREIGN PATENT DOCUMENTS

DE 602004003757 T2 10/2007
EP 1431517 A2 6/2004
EP 2615243 A1 7/2013
EP 2811118 A1 12/2014
EP 2878769 A1 6/2015

* cited by examiner

*Primary Examiner* — Jacob M Amick
(74) *Attorney, Agent, or Firm* — Barlow, Josephs & Holmes, Ltd.

(57) ABSTRACT

The invention relates to a guide vane segment for a gas turbine comprising at least one radially outer shroud and one radially inner shroud, which extend along a respective arc and together form an annular segment, wherein, in the radial direction between the outer shroud and the inner shroud, a plurality of guide vanes are arranged adjacent to one another in the peripheral direction and are joined to the inner shroud and to the outer shroud in a material-bonded manner and, in particular, are joined in a one-piece manner, wherein, in an axial lengthwise direction, the outer shroud comprises an axially front end wall element and an axially rear end wall element in such a way that the outer shroud and the two end walls form a tub-like profile in lengthwise section.

13 Claims, 4 Drawing Sheets

GUIDE VANE SEGMENT WITH RADICAL SECURING ELEMENTS

BACKGROUND OF THE INVENTION

The present invention relates to a guide vane segment for a gas turbine, in particular an aircraft gas turbine, comprising at least one radially outer shroud and one radially inner shroud, which extend along a respective arc and together form an annular segment, wherein, in the radial direction between the outer shroud and the inner shroud, a plurality of guide vanes are arranged adjacent to one another in the peripheral direction and are joined to the inner shroud and to the outer shroud in a material-bonded manner and, in particular, are joined in a one-piece manner, wherein, in an axial lengthwise direction, the outer shroud comprises an axially front end wall element and an axially rear end wall element in such a way that the outer shroud and the two end walls form a tub-like profile in lengthwise section, wherein, at the axially rear end wall, at least one radial securing element is provided, which is constructed for the purpose of securing the guide vane segment in the radial direction relative to a surrounding housing, wherein the radial securing element is designed as a projection with a support section that is constructed so as to rest against a corresponding counterpiece on the housing.

In the present application, statements of direction such as "axial" or "axially," "radial" or "radially," and "peripheral" are to be understood fundamentally as being referred to the machine axis of the gas turbine, unless something else is to be inferred explicitly or implicitly from the context.

For an improved and simplified assembly of the guide vane segments, which can also be referred to as guide vane clusters, in a gas turbine, it has been shown that the provision of radial securing elements represent a fitting alternative to the hitherto known securing catches.

What is particularly involved in the radial securing of guide vane segments, which are generally assembled together in a gas turbine to form a guide vane ring, is to secure the guide vane segments inside the turbine housing in the radial direction so as to prevent them from dropping out. During operation of the gas turbine, a torque generally acts on the guide vane segment due to the flow to which the guide vane(s) is or are exposed, said torque being of such a nature that the axially rear end wall element is pressed radially outward, whereas the axially front end wall element is pulled radially inward. This torque is absorbed at the axially rear end wall element by resting the radially outer edge thereof against the housing. However, if the turbomachine is not in operation, then the flow in the gas duct that is acting on the guide vanes is absent. The radial securing to prevent the guide vane segments from dropping out or the radial securing element described here serves above all for this case. In this way, when the turbomachine is shut down, it is prevented that the guide vane segment will be able to drop out, for example, due to the force of gravity.

Lesser forces need to be accommodated in the radial direction during operation of the gas turbine. Accommodation of forces acting in the radial direction can then optimally occur, in general, when a support surface area has a normal vector that has only vector components in the radial direction or/and in the axial direction. However, it has been shown that such support surface areas are rather complicated to manufacture when the support area is to be curved in the peripheral direction in correspondence with the radius referred to the machine axis or when the support surface area lies in a tangential plane with respect to the periphery in the region of the outer shroud.

SUMMARY OF THE INVENTION

The object of the invention is to provide a guide vane segment, the radial securing element of which makes possible a simplified fabrication.

In order to achieve this object, it is proposed that the support section has a support surface area that lies in a first plane, the normal vector of which has vector components in the peripheral direction as well as in the axial direction (AR) or/and in the radial direction (RR). In other words, the first plane is situated in space such that it intersects a tangential plane or a tangential direction with respect to the peripheral direction in a plane that is spanned by the radial direction and the peripheral direction. If the normal vector has a vector component in the peripheral direction as well as in the axial direction or in the radial direction (or in the axial and radial directions), the first plane has no curvature in the peripheral direction and can be manufactured more simply owing to this simplified geometry or shaping.

It is further proposed that, in the peripheral direction (UR) at the outer shroud, the guide vane segment has two lateral shroud surfaces arranged at a distance from each other, which are designed in such a way that they can come into contact with a lateral shroud surface of an adjacent guide vane segment, wherein the radial securing element is designed to be flush with at least one of the lateral shroud surfaces.

In this case, the guide vane segment can comprise two radial securing elements that are arranged at a distance with respect to each other in the peripheral direction, so that the guide vane segment is supported at two points in a defined manner and cannot slip out from the intended position and, in particular, cannot twist around a radially directed axis.

To this end, it is proposed that one radial securing element is designed so as to be flush with the one lateral shroud surface and the other radial securing element be arranged at a distance with respect to the other lateral shroud surface.

In this case, it is preferred that the distance of the two radial securing elements measured in the peripheral direction is smaller than the distance of the two lateral shroud surfaces measured in the peripheral direction.

It is further proposed that the radial securing element is manufactured by linear grinding. Linear grinding enables the movement of an appropriate grinding tool along a primary grinding direction and along a direction of advance that is orthogonal to it. As a result of the linear grinding, a support area, the normal vector of which has the features mentioned above, can be formed in a simple way on account of the tool geometry and the linear movement operation (primary grinding direction).

It is further proposed that the support section has a second surface area, which lies in a second plane, the normal vector of which has vector components in the peripheral direction as well as in the axial direction (AR) or/and in the radial direction (RR).

In this case, it is preferred that the second surface area and the support surface area are at an angle with respect to each other, wherein the angle formed between the first plane and the second plane lies in a range between 70° and 90°, preferably 75° to 85°, in a sectional plane that is spanned by the radial direction (RR) and the axial direction (AR).

The guide vane segment can further comprise a peripheral securing element in a central region of the rear end wall.

The object on which the invention is based is also achieved by a method for the manufacture of a guide vane segment for a gas turbine, in particular an aircraft gas turbine that comprises the following steps:

Provision of an unfinished guide vane segment (10*a*) with at least one radially outer shroud (14) and one radially inner shroud (12), which extend along one of the respective arcs and which together form an annular segment, wherein, in the radial direction (RR) between the outer shroud (14) and the inner shroud (12), a plurality of guide vanes (16) are arranged adjacent to one another in the peripheral direction (UR) and are joined to the inner shroud (12) and to the outer shroud (14) in a material-bonded manner and, in particular, are joined in a one-piece manner, wherein, in an axial lengthwise direction (AR), the outer shroud (14) comprises an axially front end wall element (22) and an axially rear end wall element (24) in such a way that the outer shroud (14) and the two end walls (22, 24) form a tub-like profile in lengthwise section, and with at least one unfinished radial securing element.

Alignment of the unfinished guide vane segment relative to a linear grinding apparatus in such a way that material can be removed from the unfinished radial securing element by means of the linear grinding apparatus.

Grinding of the unfinished radial securing element by means of the linear grinding apparatus until the unfinished radial securing element has assumed the form of a radial securing element with a support section that has a support surface area that lies in a first plane, the normal vector of which has vector components in the peripheral direction as well as in the axial direction (AR) or/and in the radial direction (RR).

In the process, the step of alignment of the unfinished guide vane segment and the step of grinding can each be carried out one time for a respective unfinished radial securing element when two or more unfinished radial securing elements are provided on the unfinished guide vane segment.

Furthermore, it is proposed that the step of alignment of the unfinished guide vane segment relative to the linear grinding apparatus is performed in such a way that the linear grinding apparatus can be guided or moved at a distance with respect to the other components of the unfinished guide vane segment during grinding of the unfinished radial securing element and, in particular, can be guided or moved at a distance with respect to a peripheral securing element or a corresponding unfinished peripheral securing element provided in the peripheral direction in a central region on the rear end wall.

The linear grinding of the radial securing elements can be adapted for different guide vane segments of different turbine stages or different gas turbines, so that, through appropriate relative alignment of the guide vane segment and the linear grinding tool, the support surface area of the radial securing element can be manufactured and so that the linear grinding apparatus does not come into contact with other components or structural parts, in particular projections and reinforcement ribs, of the guide vane segment.

Finally, the invention also relates to a gas turbine, in particular an aircraft gas turbine, comprising at least one turbine stage with a plurality of guide vane segments, which are arranged in the peripheral direction in such a way that they form a guide vane ring of the turbine stage, wherein the guide vane segments have at least one of the features described above.

BRIEF DESCRIPTION OF THE DRAWINGS

The invention will be described below with reference to the appended figures by way of example and without any limitation.

DESCRIPTION OF THE INVENTION

Figure 1:
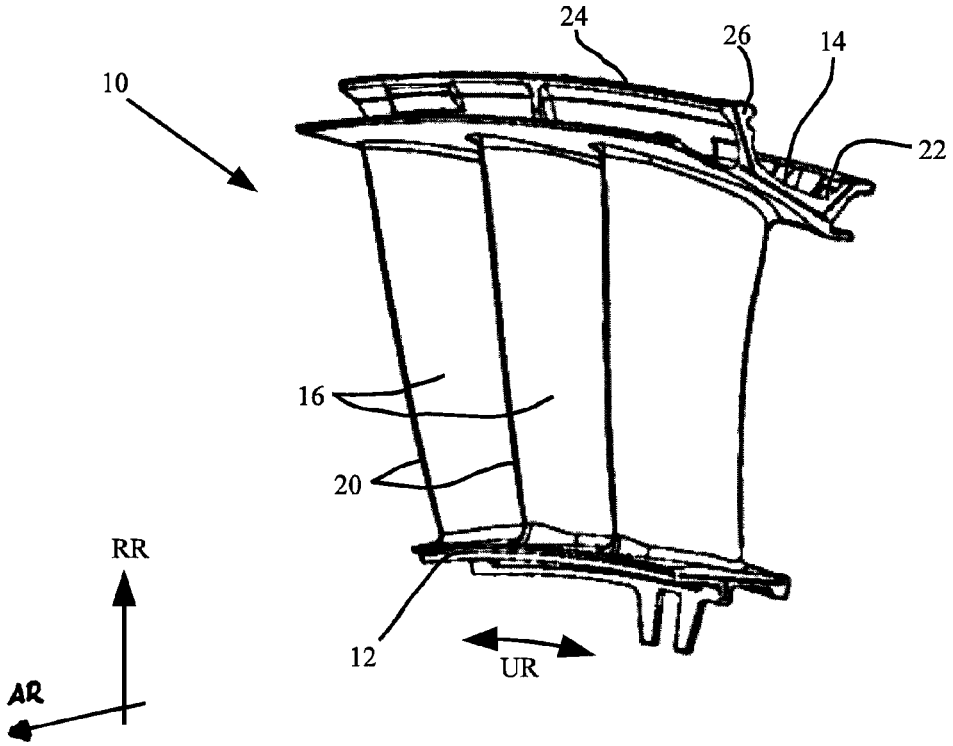
FIG. 1 shows a guide vane segment in a simplified perspective illustration.

FIG. 1 shows, in a simplified perspective illustration, a guide vane segment 10 with a radially inner shroud 12 and a radially outer shroud 14. Guide vanes 16 extend in the radial direction RR between the inner shroud 12 and the outer shroud 14, wherein the number of three guide vanes 16 illustrated here for a guide vane segment 10 is given solely by way of example; two, four, five, or more guide vanes can also be provided in a guide vane segment 10.

The guide vane segment 10 of FIG. 1 is illustrated in such a way that the view is exposed on the suction sides 18 and the trailing edges 20 of the guide vanes 16. The radially outer shroud 14 comprises an axially front end wall 22 and an axially rear end wall 24. The two end walls 22, 24 are designed so as to be inclined with respect to the shroud 14, so that, in a lengthwise section, a tub-like profile results. Further seen in FIG. 1 is a radial securing element 26, which is formed on the rear end wall 24 and protrudes from it opposite to the axial direction AR or opposite to the primary flow direction in the turbomachine.

Figure 2:
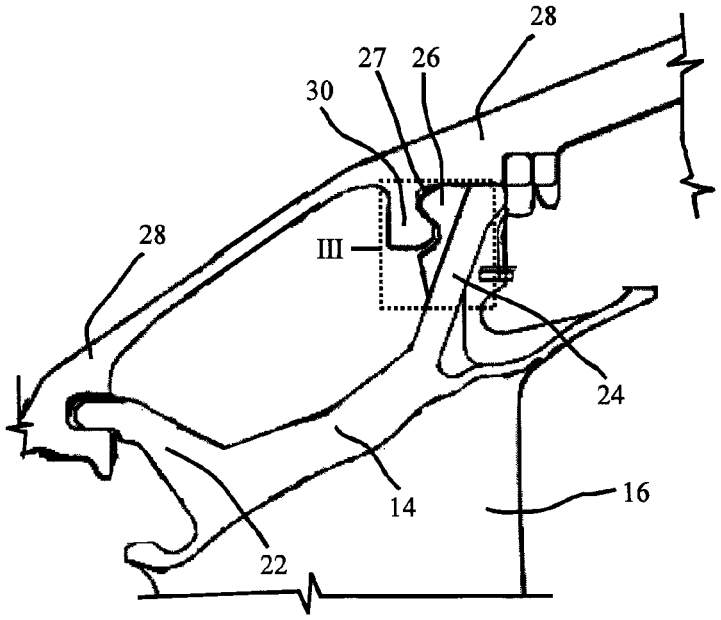
FIG. 2 shows a highly simplified lengthwise sectional illustration of a transition region between a guide vane segment and a turbine housing.

FIG. 2 shows a simplified lengthwise sectional illustration through the outer shroud 14 and a portion of a turbine housing 28 joined to the guide vane segment 10. Likewise seen from FIG. 2 are the front end wall 22 and the rear end wall 24, which, together with the shroud 14, form the tub-like profile in the sectional illustration. Seen at the rear end wall 24 is the radial securing element 26, which is formed as a projection and protrudes from the rear end wall 24 opposite to the axial direction AR. The radial securing element 26 has a support segment 27 that is essentially S-shaped in section, with a convex arc and a concave arc, which are abutted by straight pieces or surface areas. A counterpiece 30 that is formed so as to be complementary to the radial securing element 26 is formed at the housing 28, so that, between the radial securing element 26 and the counterpiece 30, a support is made possible for radial securing of the guide vane segment 10 to the housing 30.

Figure 3:
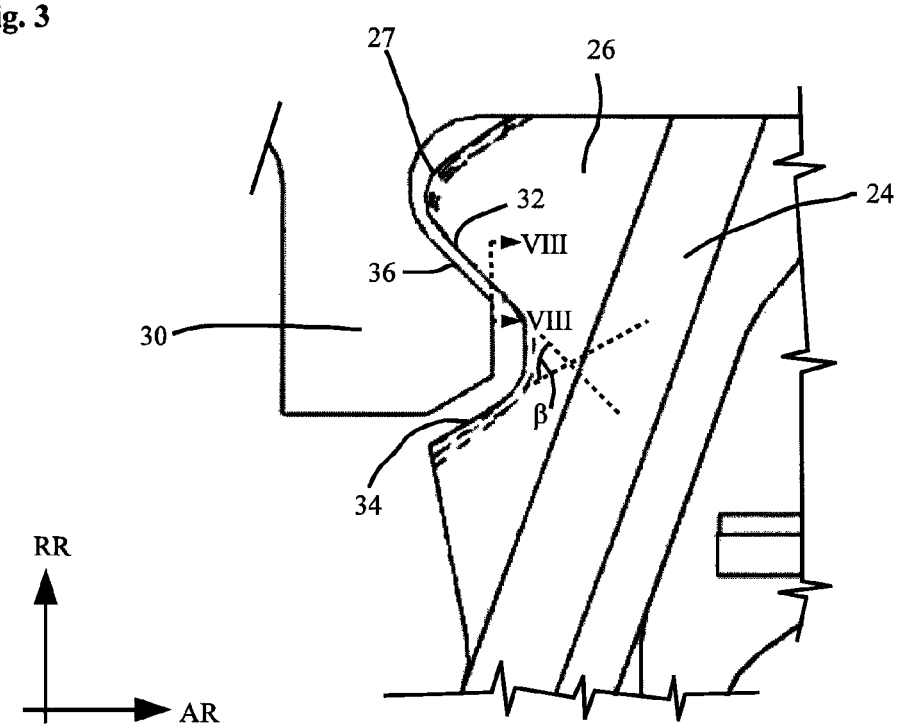
FIG. 3 shows an enlargement of region III outlined by a dashed line in FIG. 2, with a radial securing element and a counterpiece on the housing side.

FIG. 3 shows the region III, which is outlined in a broken line in FIG. 2, so that the radial securing element 26 with its support segment 27 and the counterpiece 30 of the turbine housing 28 are thereby better seen. The radial securing element 26 comprises a support surface area 32 and a second surface area 34 at its support segment 27. The counterpiece 30 has a support surface area 36, which lies opposite to the support area 32 of the radial securing element 26. As can be seen from the sectional illustration, the support surface area 32 and the second surface area 34 are formed at an angle with respect to each other, wherein, in the plane of the drawing (that is, the plane spanned by the axial direction AR and the radial direction RR), an angle β is encompassed, which preferably is about 70° to 90°, in particular about 75° to 85°. The support surface area 36 at the counterpiece 30 of the housing 28 has essentially the same inclination as does the support surface area 32. The interaction between the support surface area 32 and the support surface area 36 enables the guide vane segment 10 to be secured in the radial direction RR.

Figure 4:
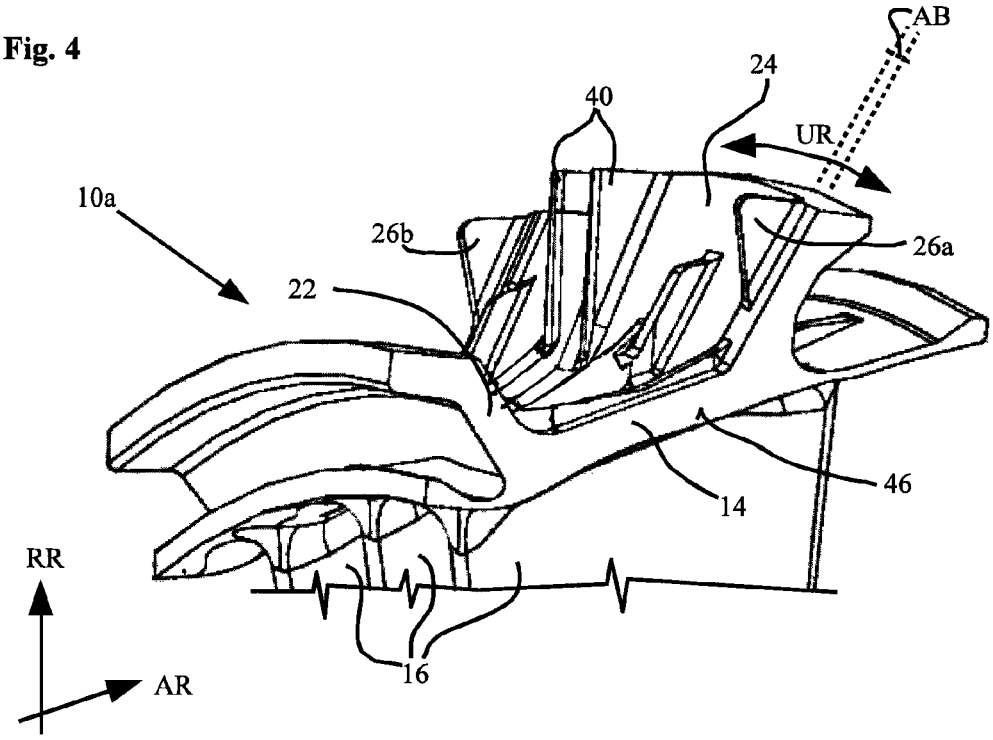
FIG. 4 shows an unfinished guide vane segment in a simplified perspective illustration.

FIG. 4 is a simplified perspective illustration of an unfinished guide vane segment 10*a* after casting such a workpiece. The already mentioned components can be seen: the outer shroud 14, the front end wall 22, the rear end wall 24, and the guide vanes 16. Seen at the rear end wall 24 are two unfinished radial securing elements 26*a* and 26*b*, which protrude from the rear end wall 24 as a kind of triangular projection opposite to the axial direction AR. A peripheral securing element 40, which is formed from two ribs and is likewise still in its unfinished form after casting, can be seen in a region of the rear end wall 24 that is central in the peripheral direction UR.

Figure 5:
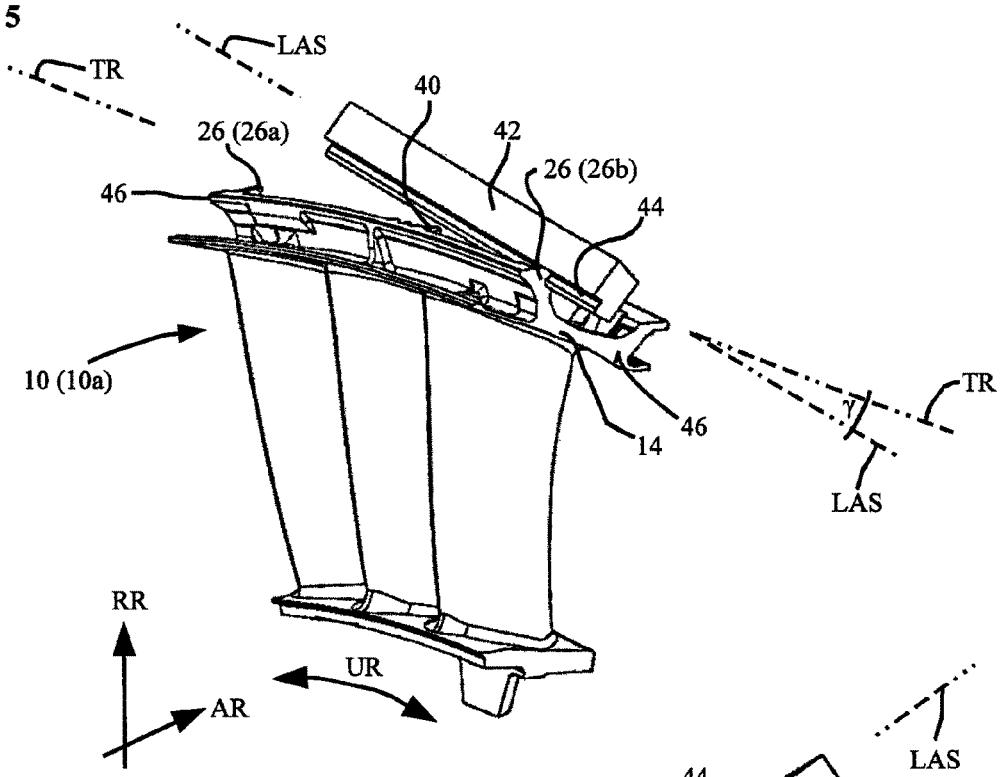
FIG. 5 shows a linear grinding apparatus in relative positioning with respect to the guide vane segment in a simplified perspective illustration of the principle.
Figure 6:
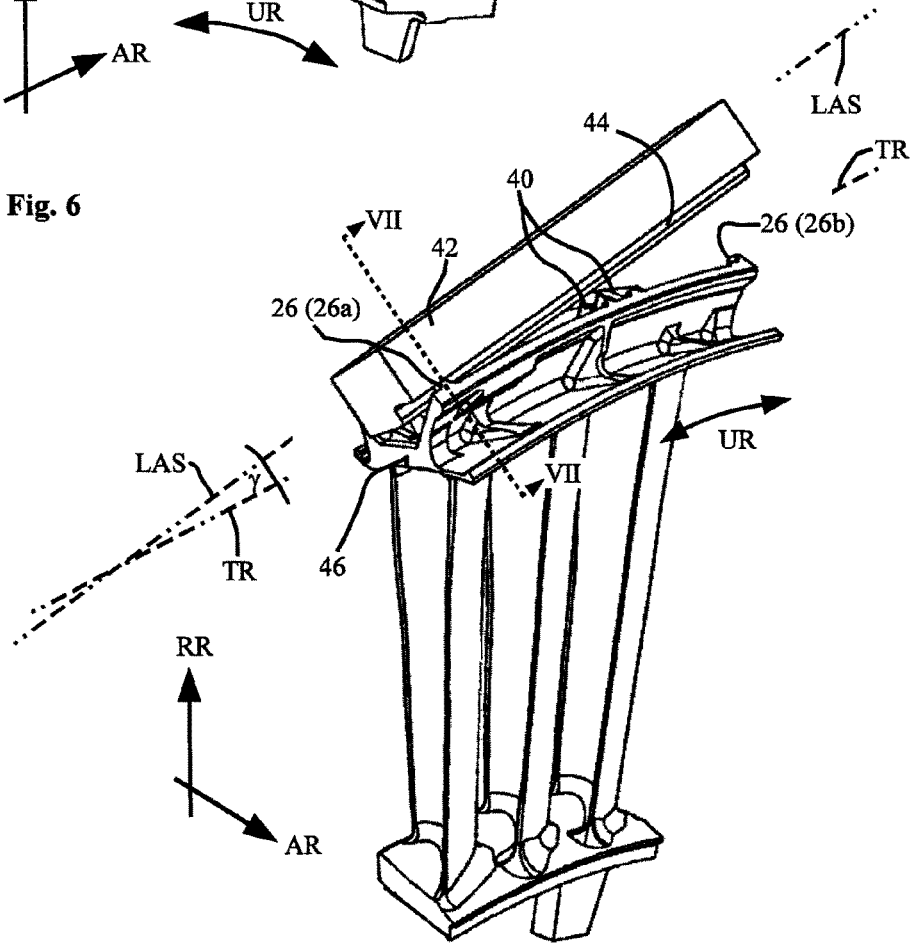
FIG. 6 shows the linear grinding apparatus in relative positioning with respect to the guide vane segment in another simplified perspective illustration of the principle.

In order to form the finished shaped radial securing elements 26, which have been previously described with reference to FIGS. 1 to 3, from the unfinished radial securing elements 26*a* and 26*b*, material is removed at the unfinished radial securing elements 26*a*, 26*b*, wherein this occurs by linear grinding. To this end, FIGS. 5 and 6 show, by way of example, the (unfinished) guide vane segment 10 (10*a*) and a simplified and schematically illustrated linear grinding apparatus 42 in different perspectives and relative arrangements with respect to each other. The linear grinding apparatus 42 and the guide vane segment 10 are aligned together in such a way that the linear grinding apparatus 42 comes with its grinding surfaces 44 in contact with one of the unfinished radial securing elements 26*a*, 26*b*. The linear grinding operation is carried out until the radial securing element 26 and its support segment 27 have attained their final form and, in particular, the support surface area 32 and the second surface area 34 are formed. Starting from the unfinished guide vane segment 10*a* of FIG. 4, FIG. 5 shows an illustration in which the linear grinding apparatus 42 processes the unfinished radial securing element 26*b*, and FIG. 6 shows an illustration in which the linear grinding apparatus 42 processes the unfinished radial securing element 26*a*. Only an upper section of the respectively other unfinished radial securing element 26*a* or 26*b*, which can also be present as an already finished processed radial securing element 26, can be seen in each of FIG. 5 or 6.

As can be seen by viewing FIGS. 4 to 6 together, the guide vane segment 10 has respective lateral shroud surfaces 46 in the region of the outer shroud 14, which are constructed such that adjacent guide vane segments 10 can rest against one another in the assembled state in the gas turbine. The guide vane segment 10 has, in each case, two lateral shroud surfaces 46, wherein each lateral shroud surface 46 can be associated with a radial securing element 26. In this case, the respective radial securing element 26 can be designed so as to be flush with the lateral shroud surface 46, such as can be seen by way of example from FIG. 5 or also from FIG. 1. Alternatively, the radial securing element 26 can be arranged at a distance AB with respect to the lateral shroud surface 46, as can be seen best from FIG. 4, but also as indicated in FIG. 6, by the left radial securing element 26 (26*a*) in FIG. 6, which is illustrated in contact with the linear grinding apparatus 42.

As can be seen from FIGS. 5 and 6, in the contact region with the radial securing element 26, the linear grinding apparatus is guided so as to be non-tangential to the curvature (along the peripheral direction UR), formed in this contact region, of the shroud 14 or the rear end wall 24. Instead, an angle γ is formed between a lengthwise axis LAS representing the grinding direction of the linear grinding apparatus 42 and the tangential direction TR in the region of the radial securing element 26. As a result of this, the support surface area 32 formed by means of the linear grinding apparatus 42 or/and the surface area 34 has or have normal vectors that, besides at least one vector component in the axial direction AR or/and the radial direction RR, also has or have a vector component in the peripheral direction UR. Such a relative positioning of the linear grinding apparatus 42 and the guide vane segment 10 with respect to each other makes it possible to remove material at the radial securing elements 26 without the linear grinding apparatus coming into contact with other components or structural parts of the guide vane segment 10 and, in particular, without coming into contact with the peripheral securing element 40, which is also provided along the peripheral direction UR at the rear end wall 24 and protrudes from the latter opposite the axial direction AR.

Figure 7:
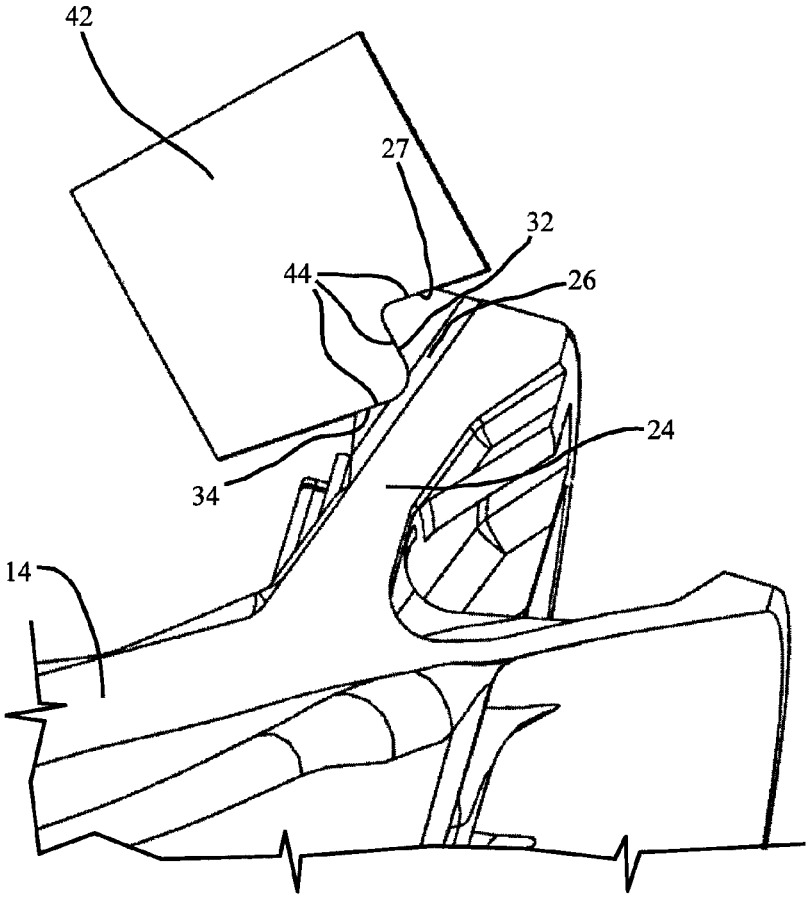
FIG. 7 shows an enlarged partial sectional illustration roughly along the sectional line VII-VII of FIG. 6.

FIG. 7 shows a simplified schematic sectional illustration roughly along the sectional line VII-VII of FIG. 6. It can be seen from this illustration that the linear grinding apparatus 42 is designed in the region of its grinding surfaces 44 in such a way that it has a contour that is complementary to the radial securing element 26 or its support segment 27. As a result of this complementary grinding contour, it is possible, by means of linear relative movement of the linear grinding apparatus 42 along the lengthwise axis LAS of the linear grinding apparatus, for successive removal of material to occur at an unfinished radial securing element 26*a*, 26*b* (FIG. 4) until the finished radial securing element 26 has been formed. Accordingly, it is possible, in comparison with linear grinding, to dispense with a rather complicated milling of the radial securing element(s) 26.

Figure 8:
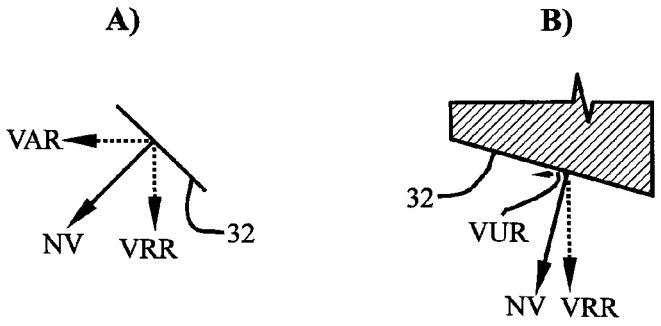
FIG. 8 shows the inclination of a support surface area of a radial securing element in subfigures A) and B) in schematic and simplified illustrations of the principle.

FIG. 8 shows, in subfigures A) and B), two highly simplified principle sectional illustrations of the support surface area 32 of the radial securing element 26 in order to illustrate the vector components of the normal vector. FIG. 8A) is a lengthwise section, as can also be seen from FIG. 1, wherein the support surface area 32 is illustrated solely as a line with the normal vector NV and the vector components VRR and VAR in radial and axial directions, respectively. FIG. 8B) is a section corresponding to the line VIII-VIII of FIG. 3, wherein the support surface area 32 is illustrated as a line and portion of the sectioned radial securing element 26 is illustrated cross-hatched. Also shown in FIG. 8B) is the normal vector NV for the support surface area 32 with the vector components VRR and VUR in radial direction and peripheral direction, respectively, visible in this illustration.

When the support surface area 32 of the radial securing element 26 is angled in the way described, wherein its normal vector has a vector component VUR in the peripheral direction, the result can be that the support surface area 32 does not come into contact over its surface area with the support surface area 36 of the counterpiece 30, but rather there is only contact between these two support surface areas 32, 36 along a line. However, the fact that there is incomplete contact of the radial securing element 26 and the counterpiece 30 is not regarded as detrimental, because, when a gas turbine is shut down, there are no large forces to be accommodated by the radial securing elements 26 and, in operation thereof, usually no forces at all are accommodated via the radial securing elements 26. It should therefore be possible to manufacture the radial securing elements in a cost-effective manner, this being possible by means of linear grinding, and it should be possible to afford a securing against any dropping out in the radial direction, in particular during assembly/disassembly of guide vane segments of a turbine stage of a gas turbine.

LIST OF REFERENCE SYMBOLS

10 guide vane segment
10*a* unfinished guide vane segment
12 inner shroud
14 outer shroud
16 guide vane
18 suction side
20 trailing edge
22 front end wall
24 rear end wall
26 radial securing element
26*a* unfinished radial securing element
26*b* unfinished radial securing element
27 support segment
28 housing
30 counterpiece
32 support surface area
34 surface area
36 support surface area
40 peripheral securing element
42 linear grinding apparatus
44 grinding surface area
46 lateral shroud surface
AB distance
AR axial direction
LAS lengthwise axis (linear grinding apparatus 42)
NV normal vector
RR radial direction
TR tangential direction
UR peripheral direction
VAR vector component in the axial direction
VRR vector component in the radial direction
VUR vector component in the peripheral direction

What is claimed is:

1. A guide vane segment for a gas turbine, comprising at least one radially outer shroud and one radially inner shroud, which extend along a respective arc and together form an annular segment, wherein, in the radial direction between the outer shroud and the inner shroud, a plurality of guide vanes are arranged adjacent to one another in the peripheral direction and are joined to the inner shroud and to the outer shroud in a material-bonded manner and are joined in a one-piece manner, wherein, in an axial lengthwise direction, the outer shroud comprises an axially front end wall element and an axially rear end wall element in such a way that the outer shroud and the two end walls form a tub-like profile in lengthwise section, wherein, at the axially rear end wall, at least one radial securing element is provided, which secures the guide vane segment in the radial direction relative to a surrounding housing, wherein the radial securing element is a projection with a support section that rests against a corresponding counterpiece on the housing, wherein the support segment has a support surface area that lies in a plane, the normal vector of which has vector components in the peripheral direction as well as in the axial direction or/and in the radial direction.

2. The guide vane segment according to claim 1, wherein the guide vane segment has, in the peripheral direction at the outer shroud, two lateral shroud surfaces arranged at a distance from each other, which are designed in such a way that they can come into contact with a lateral shroud surface of an adjacent guide vane segment, wherein the radial securing element is flush with at least one of the lateral shroud surfaces.

3. The guide vane segment according to claim 2, wherein the guide vane segment comprises, in the peripheral direction, two radial securing elements arranged at a distance with respect to each other.

4. The guide vane segment according to claim 3, wherein one radial securing element is flush with the lateral shroud surface and that the other radial securing element is arranged at a distance with respect to the other lateral shroud surface.

5. The guide vane segment according to claim 3, wherein the distance between the two radial securing elements measured in the peripheral direction is smaller than the distance between the two lateral shroud surfaces measured in the peripheral direction.

6. The guide vane segment according to claim 1, wherein the radial securing element is manufactured by linear grinding.

7. The guide vane segment according to claim 1, wherein the support segment has a second surface area that lies in a second plane, the normal vector of which has vector components in the peripheral direction as well as in the axial direction or/and in the radial direction.

8. The guide vane segment according to claim 7, wherein the second surface area and the support surface area are at an angle with respect to each other, wherein the angle formed between the first plane and the second plane in a sectional plane that is spanned by the radial direction and the axial direction lies in a range between 70° and 90°.

9. The guide vane segment according to claim 1, wherein the guide vane segment comprises, in the peripheral direction, a peripheral securing element in a central region of the rear end wall.

10. A method for the manufacture of a guide vane segment for a gas turbine, comprising the following steps:

providing an unfinished guide vane segment with at least one radially outer shroud and one radially inner shroud, which extend along a respective arc and together form an annular segment, wherein, in the radial direction between the outer shroud and the inner shroud, a plurality of guide vanes are arranged adjacent to one another in the peripheral direction and are joined to the inner shroud and to the outer shroud in a material-bonded manner and, in particular, are joined in a one-piece manner, wherein, in an axial lengthwise direction, the outer shroud comprises an axially front end wall element and an axially rear end wall element in such a way that the outer shroud and the two end walls form a tub-like profile in lengthwise section, and with at least one unfinished radial securing element;

aligning the unfinished guide vane segment relative to a linear grinding apparatus so that material can be removed from the unfinished radial securing element by means of the linear grinding apparatus;

grinding of the unfinished radial securing element by the linear grinding apparatus until the unfinished radial securing element has assumed the form of a radial securing element with a support segment that has a support surface area, which lies in a first plane, the normal vector of which has vector components in the peripheral direction as well as in the axial direction or/and in the radial direction.

11. The method according to claim 10, wherein the step of aligning the unfinished guide vane segment and the step of grinding are each carried out one time for a respective unfinished radial securing element, when two or more unfinished radial securing elements are provided at the unfinished guide vane segment.

12. The method according to claim 10, wherein the step of aligning the unfinished guide vane segment relative to the linear grinding apparatus is performed in such a way that the linear grinding apparatus can be guided or moved at a distance with respect to the other components of the unfinished guide vane segment during grinding of the unfinished radial securing element and can be guided or moved at a distance with respect to a peripheral securing element or a corresponding unfinished peripheral securing element provided in the peripheral direction in a central region on the rear end wall.

13. The guide vane segment according to claim 1, wherein a plurality of the guide vane segments is configured and arranged in a peripheral direction to form a guide vane ring for at least one turbine stage.

* * * * *